US010286667B2

(12) United States Patent
Sakurada et al.

(10) Patent No.: US 10,286,667 B2
(45) Date of Patent: May 14, 2019

(54) RECORDING DEVICE

(71) Applicant: SEIKO EPSON CORPORATION, Tokyo (JP)

(72) Inventors: Kazuaki Sakurada, Suwa (JP); Toru Fujita, Matsumoto (JP); Takamitsu Kondo, Azumino (JP); Seigo Momose, Matsumoto (JP); Akira Yamada, Matsumoto (JP); Masahisa Otake, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 6 days.

(21) Appl. No.: 15/462,252

(22) Filed: Mar. 17, 2017

(65) Prior Publication Data

US 2017/0274650 A1 Sep. 28, 2017

(30) Foreign Application Priority Data

Mar. 22, 2016 (JP) ..... 2016-056608

(51) Int. Cl.

| | |
|---|---|
| ***B41J 2/145*** | (2006.01) |
| ***B41J 2/15*** | (2006.01) |
| ***B41J 2/21*** | (2006.01) |
| ***B41J 2/51*** | (2006.01) |

(52) U.S. Cl.

CPC ..... *B41J 2/145* (2013.01); *B41J 2/15* (2013.01); *B41J 2/2132* (2013.01); *B41J 2/51* (2013.01); *B41J 2/512* (2013.01)

(58) Field of Classification Search

CPC ..... B41J 2/15; B41J 2/2132; B41J 2/51; B41J 2/512; B41J 2/145

See application file for complete search history.

(56) References Cited

U.S. PATENT DOCUMENTS

| | | | | |
|---|---|---|---|---|
| 7,506,945 | B2 * | 3/2009 | Noguchi | B41J 2/2128 347/12 |
| 8,491,094 | B2 * | 7/2013 | Kamijo | B41J 2/155 347/43 |
| 8,608,283 | B1 * | 12/2013 | Phillips | B41J 2/2103 347/43 |
| 9,199,463 | B2 * | 12/2015 | Nishikawa | B41J 2/1433 |
| 9,415,595 | B2 * | 8/2016 | Sudo | B41J 2/2139 |
| 2012/0242729 | A1 | 9/2012 | Takahashi et al. | |
| 2014/0247308 | A1 | 9/2014 | Takahashi et al. | |
| 2016/0059579 | A1 | 3/2016 | Takahashi et al. | |

FOREIGN PATENT DOCUMENTS

| | | |
|---|---|---|
| JP | 2012-200920 | 10/2012 |
| JP | 2013-215993 | 10/2013 |

* cited by examiner

*Primary Examiner* — Lamson D Nguyen
(74) *Attorney, Agent, or Firm* — Workman Nydegger

(57) ABSTRACT

A recording device includes, when a transporting direction of a medium is set to a first axis and a direction intersecting with the transporting direction is set to a second axis, a head which includes a nozzle column along the first axis; a pair of heads in which the heads discharging droplets of the same color are paired; and a head unit which includes a plurality of pairs of heads along the second axis. The pair of heads include a predetermined overlapping portion in which the nozzle columns are overlapped with each other in a side view from the second axis, the overlapping portion includes a plurality of nozzle regions divided along the second axis, and a position of the nozzle region which is used in discharge of the droplets is different from a position of the nozzle region of another pair of heads.

3 Claims, 5 Drawing Sheets

RECORDING DEVICE

BACKGROUND

1. Technical Field

The present invention relates to a recording device.

2. Related Art

A recording device which performs printing on a sheet-like recording medium by an ink jet method is known. The recording device includes a plurality of heads having a plurality of nozzles and transports the recording medium and discharges ink while moving the head in a direction (main scanning direction) perpendicular to a transporting direction (sub scanning direction) of the recording medium. In addition, in the recording device, head columns in which the heads are arranged in the sub scanning direction are arranged in the main scanning direction for each color of ink. In addition, the ink discharged from each nozzle is landed on the recording medium. Each landing region on which the ink is landed constitutes a portion of an image on the recording medium, respectively, and as a result, the gathering of these landing regions is recognized as the image.

In such a recording device, since seams (overlapping portions) of heads of adjacent head columns are overlapped with each other in the sub scanning direction, image portions which are printed at the seams of the head columns of each color are overlapped with each other and thus a problem of color unevenness and density unevenness being generated occurs. Attempts have been made to eliminate the density unevenness by shifting the seams of the heads of the head columns having different colors from each other in the sub scanning direction (for example, JP-A-2013-215993).

However, in the recording device of JP-A-2013-215993, an overlapping portion is provided for each color of ink, and a pair of heads are shifted in the sub scanning direction so that the overlapping portion of each color does not actually overlap with the overlapping portion of another head. Therefore, in a case where the number of colors of ink is increased, the size of a head unit is increased in the sub scanning direction, resulting in an increase in size of the recording device.

SUMMARY

The invention can be realized in the following aspects or application examples.

Application Example 1

According to the application example, there is provided a recording device including, when a transporting direction of a medium is set to a first axis and a direction intersecting with the transporting direction is set to a second axis, a head which includes a nozzle column along the first axis; a pair of heads in which the heads discharging droplets of the same color are paired, and a head unit which includes a plurality of pairs of heads along the second axis. The pair of heads include a predetermined overlapping portion in which the nozzle columns are overlapped with each other in a side view from the second axis, the overlapping portion includes a plurality of nozzle regions divided along the second axis, and a position of the nozzle region which is used in discharge of the droplets is different from a position of the nozzle region of another pair of heads in at least one of the plurality of pairs of heads.

According to the application example, the pair of heads which discharge droplets having the same color have overlapping portions which are divided into a plurality of nozzle regions. For example, in a case where two pairs of heads which discharge droplets having different colors are provided in the head unit, even if the positions of the two pairs of heads in the first axis are the same, the position of seam of the image which is formed for each color is shifted in the first axis direction by the nozzle regions to which the droplets are discharged in the overlapping portion being different from each other. Accordingly, the position of the seam of each color can be changed without increasing the size of the head unit in the first axis direction. Therefore, the recording device which can achieve both improvement in printing quality and miniaturization of the device can be provided.

Application Example 2

In the recording device according to the application example described above, it is preferable that at least two of the plurality of pairs of heads have the same position in the first axis.

According to the application example, since at least two of the plurality of pairs of heads have the same position in the first axis, the size of the head unit in the first axis direction can be reduced.

Application Example 3

In the recording device according to the application example described above, it is preferable that color of the droplets which are discharged from the heads arranged along the second axis be line-symmetrical with respect to the center line along the first axis of the head unit.

According to the application example, since the color of the droplets which are discharged from the heads arranged along the second axis is line-symmetrical with respect to the center line along the first axis of the head unit, the printing quality can be improved. For example, in a case where printing of a green color is performed by landing droplets at the same location (pixel) from a head which discharges cyan droplets and a head which discharges yellow droplets, color difference is generated by the landing order of the cyan droplets and the yellow droplets being different from each other in a forward movement and a backward movement in the main scanning direction of the head (head unit). In the application example, since the color of the droplets which is discharged from the heads arranged along the second axis is line-symmetrical with respect to the center line along the first axis of the head unit, the landing order of the droplets can be the same in the forward movement and the backward movement of the head unit. Accordingly, the printing quality of the recording device is improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings. In the following drawings, the scale of each layer and each member is made different from the actual scale thereof in order to make each layer and each member size recognizable.

In addition, in FIG. 1 and FIG. 3 to FIG. 6, the X axis, the Y axis and the Z axis are illustrated as three axes which are perpendicular to each other for convenience of explanation, and a distal end side of the arrow illustrating the axial direction is indicated as "+side" and the proximal end side thereof is "−side". In addition, in the following description, a direction which is parallel to the X axis is referred to as "X axis direction", a direction which is parallel to the Y axis is referred to as "Y axis direction", and a direction which is parallel to the Z axis is referred to as "Z axis direction". A first axis which is a transporting direction of a medium corresponds to the Y axis and a second axis which intersects with the transporting direction corresponds to the X axis.

Embodiment 1

Schematic Configuration of Recording Device

Figure 1:
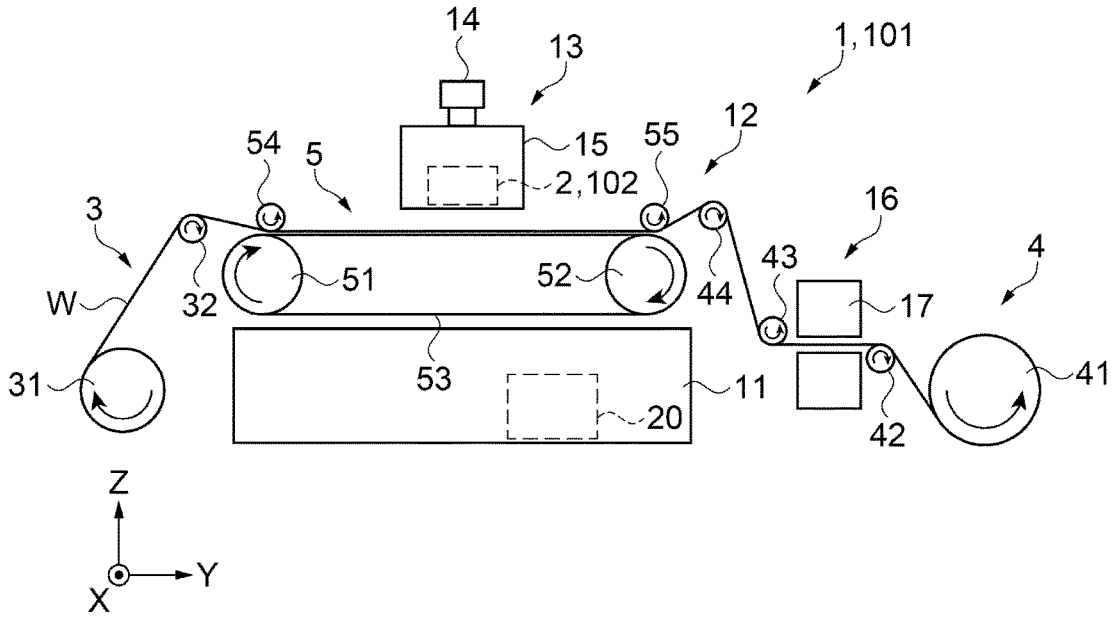
FIG. 1 is a schematic view illustrating a schematic overall configuration of a recording device according to Embodiment 1.
Figure 2:
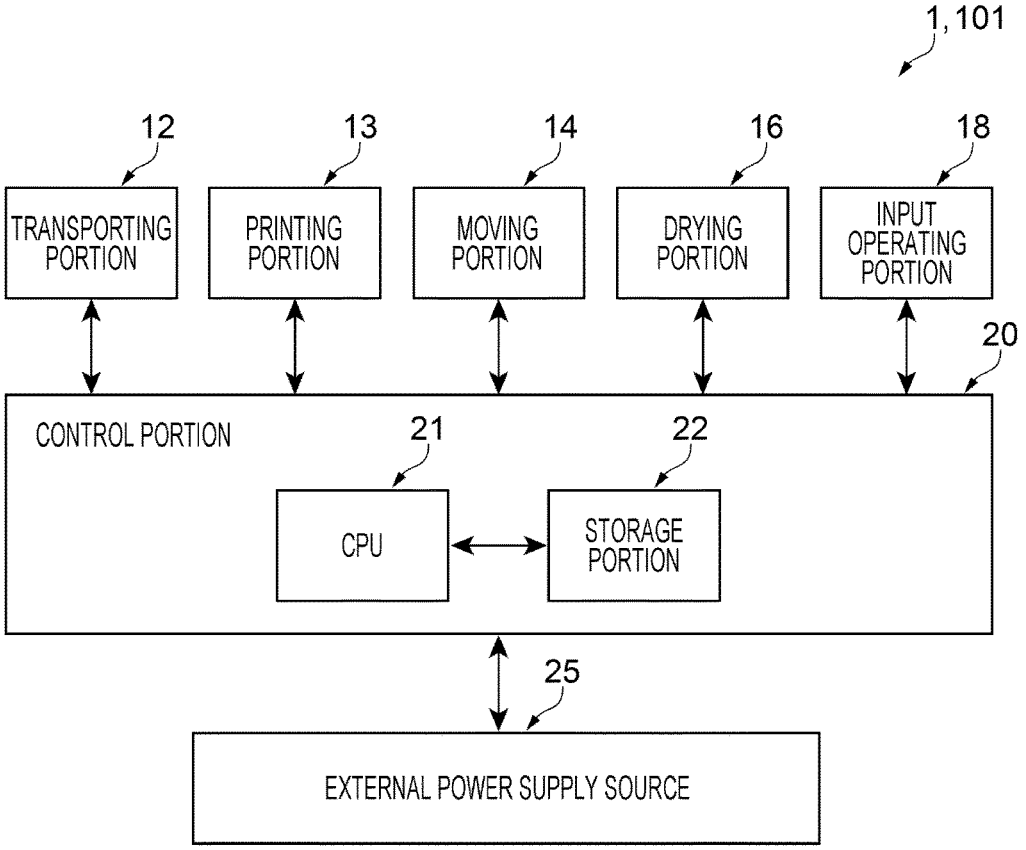
FIG. 2 is an electrical block diagram illustrating an electrical configuration of the recording device.

FIG. 1 is a schematic view illustrating a schematic overall configuration of a recording device according to Embodiment 1. FIG. 2 is an electrical block diagram illustrating an electrical configuration of the recording device. First, a schematic configuration of a recording device 1 according to the embodiment will be described with reference to FIG. 1 and FIG. 2. In the embodiment, an ink jet type recording device 1 which performs printing on a medium W by forming an image or the like on the medium W will be described as an example.

As illustrated in FIG. 1 and FIG. 2, the recording device 1 includes a machine base 11, a transporting portion 12 which transports the medium W in a first axis (+Y axis) direction, a printing portion 13 which performs printing by ink as droplets being discharged on the medium W, a moving portion 14 which moves the printing portion 13, a drying portion 16 which dries the ink landed on the medium W, an input operating portion 18 which performs input and setting of various conditions during printing, and a control portion 20 which controls operations of these portions, respectively. In addition, in the recording device 1, the control portion 20 is electrically connected to an external power supply source 25.

The transporting portion 12 includes an unwinding device 3 which unwinds an elongated medium W which is wound in a roll shape, a winding device 4 which winds up the printed medium W, and a supporting device 5 which is disposed on the machine base 11 and which supports the medium W during printing.

The unwinding device 3 is disposed on an upstream side of the machine base 11 in the transporting direction (+Y axis direction) of the medium W. The unwinding device 3 includes a feeding roller 31 which winds up the medium W in a roll shape and feeds the medium W, and a tensioner 32 which applies tension to the medium W between the feeding roller 31 and the supporting device 5. A motor (not illustrated) is connected to the feeding roller 31 and the feeding roller 31 can be rotated by the operation of the motor.

As the medium W, a material to be printed can be used. The material to be printed refers to fabrics, clothes, or other clothing products for example which are to be printed. The fabric includes natural fibers such as cotton, hemp, silk and wool, chemical fibers such as nylon, and composite fibers obtained by mixing these fibers such as woven fabrics, knitted fabrics, and nonwoven fabrics. In addition, clothes and other clothing products include T-shirts, handkerchiefs, scarves, towels, handbags, fabric bags, curtains, sheets, or other furniture such as bed covers after sewing, and fabrics before and after cutting existing as parts in the state before sewing.

In addition, as the medium W, special paper for ink jet recording such as plain paper, high quality paper and glossy paper can be used, in addition to the above-described material to be printed. In addition, as the medium W, for example, a plastic film which is not subjected to a surface treatment for ink jet printing (that is, which does not form an ink absorbing layer), or a medium coated with a plastic or having a plastic film bonded on a base material such as paper can be also used. The plastic is not particularly limited, but examples thereof include polyvinyl chloride, polyethylene terephthalate, polycarbonate, polystyrene, polyurethane, polyethylene, or polypropylene.

The winding device 4 is disposed on a downstream side of the machine base 11 in the transporting direction (+Y axis direction) of the medium W with respect to the unwinding device 3. The winding device 4 has a winding roller 41 for winding the medium W in a roll shape and tensioners 42, 43, and 44 for applying tension to the medium W between the winding roller 41 and the supporting device 5. A motor (not illustrated) is connected to the winding roller 41, and the winding roller 41 can be rotated by the operation of the motor. The tensioners 42, 43, and 44 are disposed at intervals in this order in a direction away from the winding roller 41.

The supporting device 5 is disposed between the unwinding device 3 and the winding device 4. The supporting device 5 includes a main driving roller 51 and a driven roller 52 which are disposed to be spaced apart from each other in the Y axis direction, an endless belt 53 which is passed over the main driving roller 51 and the driven roller 52, and tensioners 54 and 55 for applying tension to the medium W between the main driving roller 51 and the driven roller 52.

A motor (not illustrated) is connected to the main driving roller 51 and the main driving roller 51 can rotate by the operation of the motor. In addition, a rotational force of the main driving roller 51 is transferred to the driven roller 52 via the endless belt 53, and the driven roller 52 can be rotated in conjunction with the main driving roller 51.

The endless belt 53 is a glue belt having a sticky adhesive layer formed on a surface side thereof. A portion of the medium W is fixed to the adhesive layer by adhesion, and the medium W is transported in the +Y axis direction. During this transport, the medium W is stably printed. In addition, the medium W is peeled off from the endless belt 53 after printing is performed.

The tensioners 54 and 55 are disposed to be spaced apart from each other in the Y axis direction, like the main driving roller 51 and the driven roller 52.

The medium W together with the endless belt 53 can be sandwiched between the main driving roller 51 and the tensioner 54, and between the tensioner 55 and the driven roller 52. Accordingly, the medium W to which the tension is applied by the tensioners 54 and 55 is fixed to the endless belt 53 and transported in a state where the tension is applied. Due to such a state, for example, wrinkles or the like are prevented from being generated in the medium W during transport. Accordingly in a case where printing is performed, the printing thereof has an accurate and high quality.

The printing portion 13 discharges ink as droplets onto the medium W which is transported by the transporting portion 12 and performs drawing (recording) by the printing. The printing portion 13 includes a carriage 15 on which a head unit 2 discharging droplets toward a medium W is mounted.

The ink contains a dye or a pigment as a coloring agent in water as a solvent, and for example, four colors of black (K), cyan (C), magenta (M), and yellow (Y) are used.

The recording device 1 performs sub scanning in which the medium W unwound by the unwinding device 3 is intermittently fed in the Y axis direction in a fixed state of being fixed to the endless belt 53 by adhesion and a main scanning in which ink is discharged from the head unit 2 while the carriage 15 is reciprocated with respect to the medium W in the fixing state in the X axis direction by the moving portion 14. An image is formed on the medium W by alternately performing the sub scanning and the main scanning. The obtained image may be based on multicolor printing (color printing) or single color printing.

The moving portion 14 supports the printing portion 13 so as to be movable along the X axis direction during printing. Accordingly, the printing portion 13 can reciprocate on the medium W, and in the meantime, the ink can be discharged toward the medium W as droplets. It is preferable that a ball screw and a linear guide be provided as configurations of the moving portion 14, for example.

The drying portion 16 is disposed between the supporting device 5 and the winding roller 41 of the winding device 4 by being disposed on the downstream side of the printing portion 13 in the transporting direction of the medium W. The drying portion 16 has a chamber 17 in which a heater is housed. Accordingly, when the medium W passes through an inside of the chamber 17, the wet ink on the medium W can be dried by heat from the heater.

The tensioner 42 and the tensioner 43 are disposed on both sides in the Y axis direction of the drying portion 16. Accordingly, the medium W can pass through the inside of the chamber 17 in a state where the tension is applied. By this state, since wrinkles are prevented from being generated in the medium W during passage, for example, the drying of the ink can be ensured.

The input operating portion 18 includes a touch panel or the like, for example. An operator of the recording device 1 can input various conditions during printing via the input operating portion 18. The conditions are not particularly limited and include printing program, transport speed and thickness of the medium W, for example. The input operating portion 18 also serves as a displaying portion for displaying information in the recording device 1.

The control portion 20 is electrically connected to the transporting portion 12, the printing portion 13, the moving portion 14, the drying portion 16, and the input operating portion 18, and has a function of controlling operations thereof, respectively. As illustrated in FIG. 2, the control portion 20 includes a central processing unit (CPU) 21 and a storage portion 22.

The CPU 21 executes programs for various processing such as the printing processing described above.

The storage portion 22 includes an electrically erasable programmable read only memory (EEPROM), which is a kind of non-volatile semiconductor memory or the like, for example, and can store various programs or the like.

The control portion 20 is electrically connected to the external power supply source 25 which applies a voltage of 200 V, for example. Accordingly, electric power is supplied to each portion of the recording device 1.

Head Unit

Figure 6:
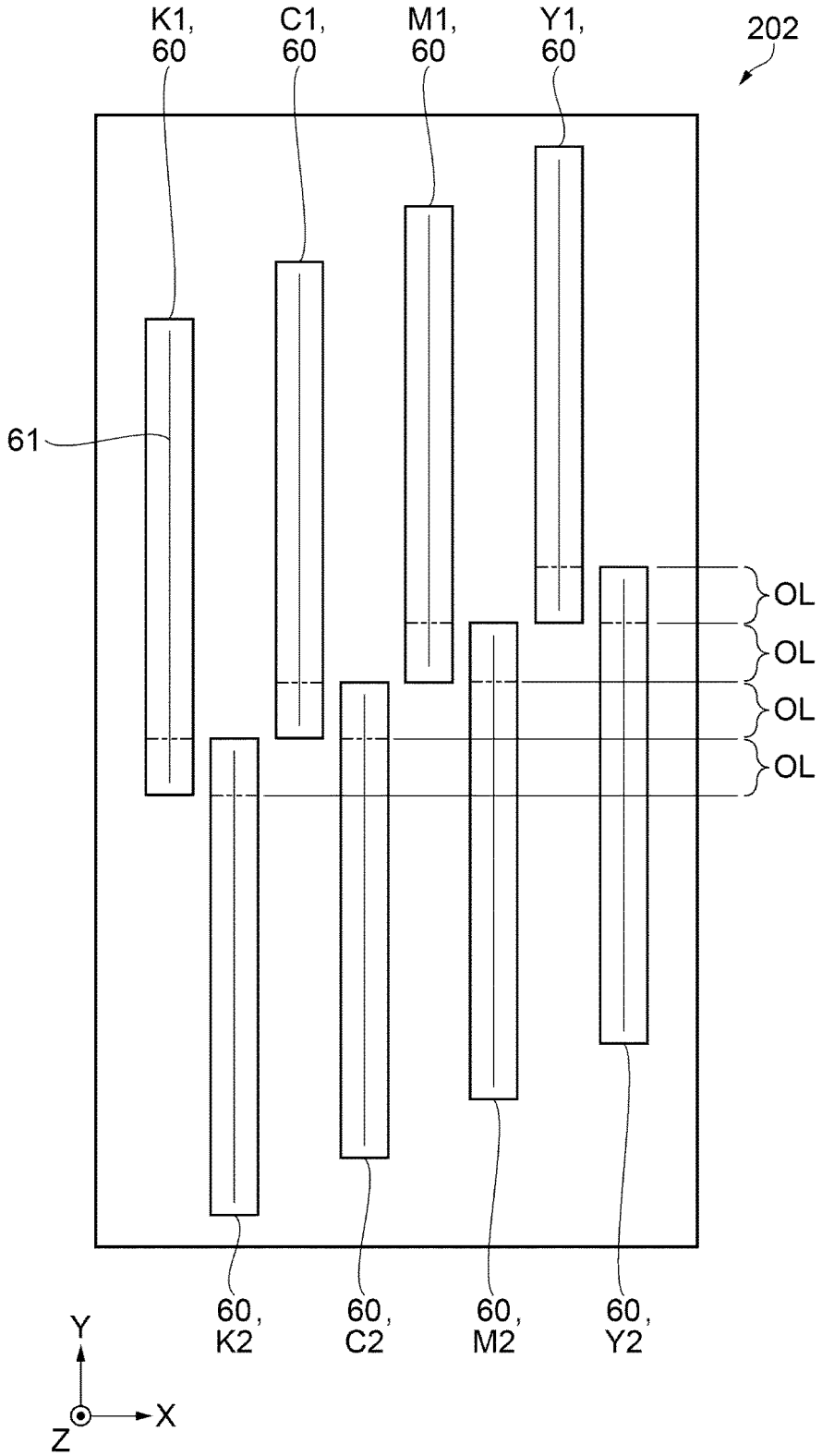
FIG. 6 is a plan view illustrating a configuration example of a head unit according to the related art.

FIG. 6 is a plan view illustrating a configuration example of the head unit according to the related art. A configuration example of the head unit in the related art will be described, before describing the configuration of the head unit of the present embodiment.

As illustrated in FIG. 6, a head unit 202 has four pairs of heads 60 in which heads for discharging droplets of the same color are paired. The four pairs of heads discharge ink of black (K), cyan (C), magenta (M), and yellow (Y). In the following description, in a case where an individual head is identified, a first head from which K ink is discharged is referred to as "Head K1" and a second head from which K ink is discharged is referred to as "Head K2". In addition, a pair of heads which include head K1 and head K2 are referred to as "pair of heads K12". A head and a pair of heads from which C ink, M ink or Y ink is discharged are described in the same manner as the head and the pair of heads from which K ink is discharged.

Eight heads 60 each including a nozzle column 61 along the first axis (Y axis) include head K1, head K2, head C1, head C2, head M1, head M2, head Y1, and head Y2 in this order along the second axis (+X axis) intersecting with the transporting direction of the medium in the head unit 202. A predetermined overlapping portion OL in which the nozzle columns 61 are overlapped with each other in the X axis direction is provided in each of the heads 60 forming each of the pairs of heads K12, C12, M12, and Y12. Each pair of heads K12, C12, M12, and Y12 are shifted in the Y axis direction so as not to overlap with the overlapping portions OL of the pairs of heads which discharge ink of the other colors in the X axis direction. Although the printing quality is guaranteed by this configuration, since the head unit 202 shifts all the heads 60 in the Y axis direction, the size of the head unit 202 in the Y axis direction becomes large and thus the recording device leads to an increase in size.

Next, the configuration of the head unit 2 of the embodiment will be described.

Figure 3:
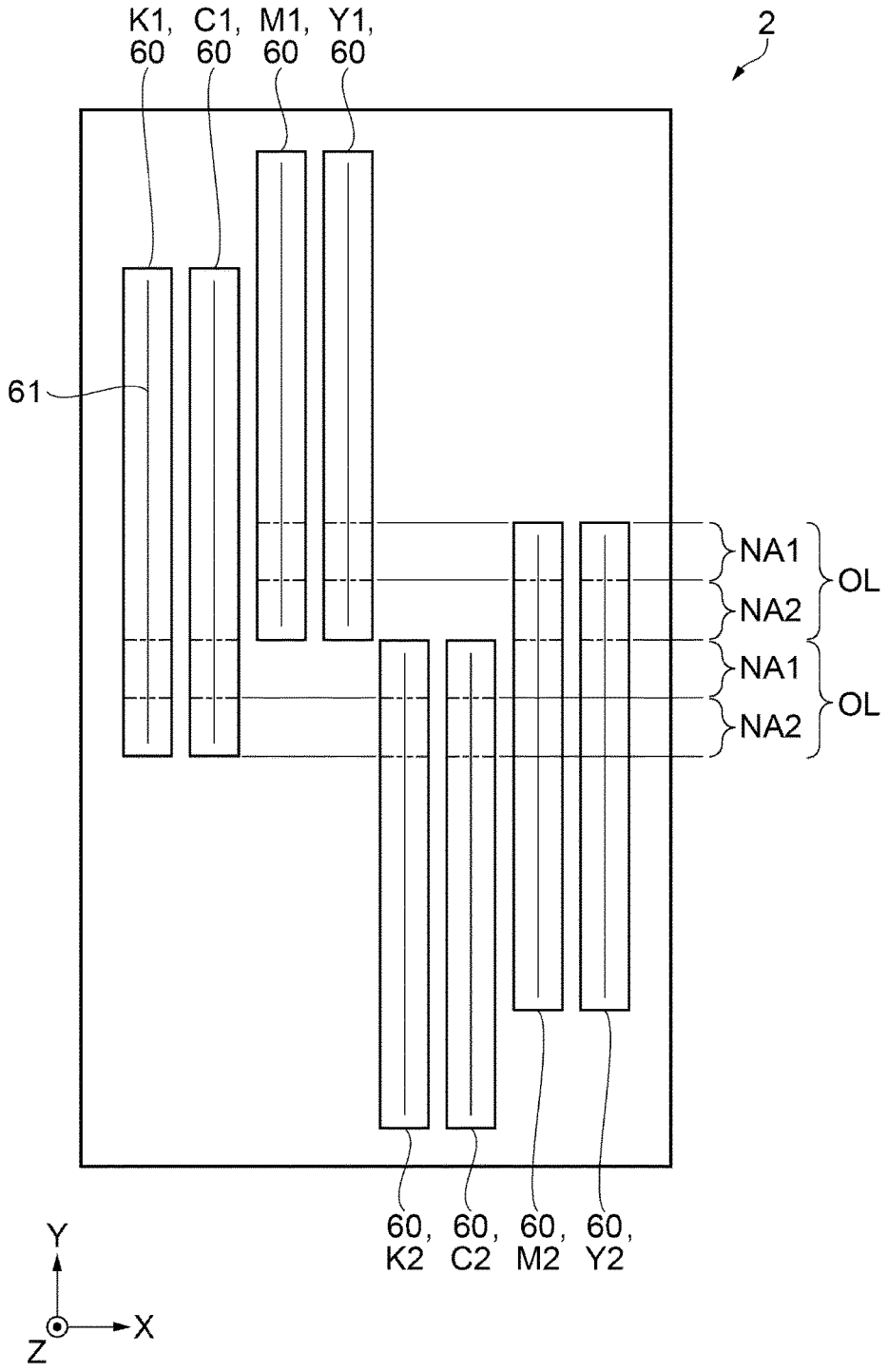
FIG. 3 is a plan view illustrating a configuration example of a head unit.
Figure 4:
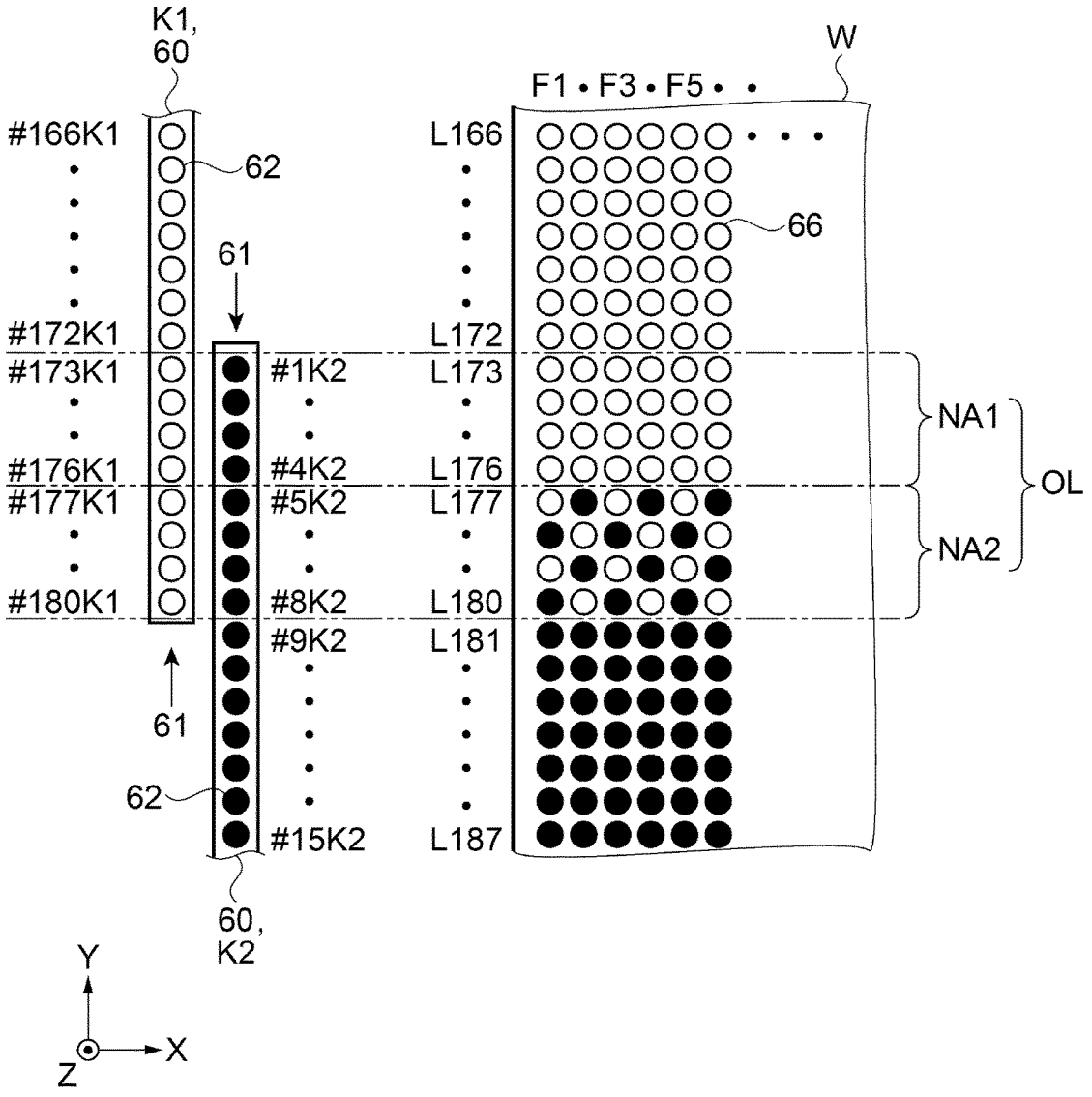
FIG. 4 is a view explaining dots which are formed on a medium.

FIG. 3 is a plan view illustrating a configuration example of a head unit. FIG. 4 is a view explaining dots which are formed on a medium. In FIG. 4, for the sake of simplicity of explanation, printing is performed by a pair of heads K12 provided in the head unit.

As illustrated in FIG. 3, the head unit 2 includes four pairs of heads K12, C12, M12, and Y12 in which heads 60 for discharging droplets of the same color are paired. The four pairs of heads K12, C12, M12, and Y12 discharge ink of the block (K), cyan (C), magenta (M), and yellow (Y).

Eight heads 60, each of which includes a nozzle column 61 along the first axis (Y axis) include head K1, head C1, head M1, head Y1, head K2, head C2, head M2, and head Y2 in this order along the second axis (+X axis) in the head unit 2.

The head K1 and the head K2 form a pair of heads K12 for discharging the K ink, and the head C1 and the head C2 form a pair of heads C12 for discharging the C ink.

The head M1 and the head M2 form a pair of heads M12 for discharging the M ink, and the head Y1 and the head Y2 form a pair of heads Y12 for discharging the Y ink.

In other words, the head unit 2 includes a plurality (four) of pairs of heads K12, C12, M12, and Y12 along the second axis (+X axis).

Each of the pairs of heads K12, C12, M12, and Y12 has a predetermined overlapping portion OL in which the nozzle columns 61 are overlapped with each other in a side view from the second axis (X axis). Further, the overlapping portion OL has a plurality of nozzle regions (first nozzle region NA1 and second nozzle region NA2) which are divided along the first axis (Y axis). Specifically, in the pairs of heads K12, C12, M12, and Y12, in a side view from the X axis direction, the −Y axis end sides of the heads K1, C1, M1, and Y1 and the +Y axis end side of the heads K2, C2, M2, and Y2 are overlapped by the width of a predetermined overlapping portion OL. The overlapping portion OL of each of the pairs of heads K12, C12, M12, and Y12 is divided into two portions, that is the first nozzle region NA1 and the second nozzle region NA2 in this order from the +Y axis direction.

At least two of the plurality of pairs of heads K12, C12, M12, and Y12 have the same position on the first axis (Y axis).

In the embodiment, since the positions along the Y axis of the pair of heads K12 and the pair of heads C12 are the same, the positions along the Y axis of the overlapping portion OL, the first nozzle region NA1 and second nozzle region NA2 are also the same. Since the positions along the Y axis of the pair of heads M12 and the pair of heads Y12 are the same, the positions along the Y axis of the overlapping portion OL, the first nozzle region NA1 and second nozzle region NA2 are also the same.

In addition, the positions of the pair of heads K12 and C12 in the Y axis are shifted in the −Y axis direction by the length of the overlapping portion OL with respect to the pairs of heads M12 and Y12. In other words, the position of the overlapping portion OL of the pairs of heads K12 and C12 in the Y axis and the position of the overlapping portion OL of the pairs of heads M12 and Y12 in the Y axis are arranged so as not to overlap each other.

In at least one of the pairs of heads K12, C12, M12, and Y12, the position of the nozzle region which is used in discharge of droplets from both of the pair of heads is different from the position of the nozzle region of another pair of heads in the overlapping portion OL that is used in discharge of droplets from both of the other pair of heads. In the embodiment, in each of the pairs of heads K12, C12, M12, and Y12, the position of the nozzle region which is used in the discharge of droplets is different in the Y axis direction from the overlapping portion positions of the other pairs of heads.

Specifically, the pair of heads K12 discharge droplets from both the head K1 and the head K2 in the second nozzle region NA2, and the pair of heads C12 discharge droplets from both the head C1 and the head C2 in the first nozzle region NA1.

The pair of heads M12 discharge droplets from both the head M1 and the head M2 in the second nozzle region NA2 and the pair of heads Y12 discharge droplets from both the head Y1 and the head Y2 in the first nozzle region NA1.

Here, the dot which is formed on the medium will be explained.

FIG. 4 is a view explaining the dots which are formed by the pair of heads which discharge the K ink.

In FIG. 4, the structure of the pair of heads K12 is illustrated on the left side, and the dots 66 which are formed on the medium W are illustrated on the right side. In addition, a nozzle 62 of the head K1 and the dots 66 which are formed by the droplets discharged from the head K1 are illustrated by white circles "○" and the nozzle 62 of the head K2 and the dots 66 which are formed by the droplets discharged from the head K2 are illustrated by black circles "●". In the embodiment, the nozzle column 61 having 180 nozzles 62 as an example is provided in the first head K1 and the second head K2 and each of eight nozzles 62 which are overlapped with each other in the X axis direction is provided in the overlapping portion OL. In addition, the nozzle numbers (#166K1 to #180K1, #1K2 to #15K2) corresponding to each nozzle 62 are attached to the side of each of the heads K1 and K2. In addition, in the following description, for example, the nozzle 62 of nozzle number #1K2 is written to as nozzle #1K2.

As illustrated in FIG. 4, in the overlapping portion OL of the pair of heads K12, the nozzles #173K1 to #180K1 of the head K1 and the nozzles #1K2 to #8K2 of the head K2 are overlapped with each other in the X axis direction. In addition, the nozzles #173K1 to #176K1 of the head K1 and the nozzles #1K2 to #4K2 of the head K2 belong to the nozzle region NA1 and the nozzles #177K1 to #180K1 of the head K1 and nozzles #5K2 to #8K2 of the head K2 belong to the nozzle region NA2.

A dot column (raster line) which is arranged along the main scanning direction (X axis direction) is printed on the medium W by the head unit 2 performing main scanning. In FIG. 4, the row numbers (L166 to L187) corresponding to each raster line are attached to the side of the medium W. In addition, column numbers (F1 to F6) in the sub scanning direction (Y axis direction) in which the dots 66 are formed are attached on the upper side of the medium W in FIG. 4.

For example, the raster lines (dot 66) of row numbers L166 to L176 are formed by droplets discharged from nozzles #166K1 to #176K1 of head K1, and the raster lines of row numbers L181 to L187 are formed by droplets discharged from nozzles #9K2 to #15K2 of the head K2.

The raster lines (row numbers L177 to L180) belonging to the nozzle region NA2 are formed by droplets which are discharged alternately from both of the nozzles 62 (nozzles #177K1 to #180K1) belonging to the nozzle region NA2 of the head K1 and the nozzles 62 (nozzles #5K2 to #8K2) belonging to the nozzle region NA2 of the head K2. For example, droplets are discharged from nozzle #177K1 of the head K1 to odd-numbered column numbers F1, F3 and F5 of the row number L177, and droplets are discharged from nozzle #5K2 of the head K2 to even-numbered column numbers F2, F4 and F6 the row number L177. Accordingly, the seam between the image formed by the first head K1 and the image formed by the second head K2 is unlikely to be seen.

In addition, in the pair of heads C12 having a position which is the same as the position of the pair of heads K12 in the Y axis, raster lines (row numbers L173 to L176) belonging to the nozzle region NA1 are formed by droplets which are alternately discharged from the nozzles 62 belonging to the nozzle region NA1 of the head C1 and the nozzles 62 belonging to the nozzle region NA1 of the head C2. Accordingly, without shifting the position of the pairs of heads K12 and C12 in the Y axis, the positions of the seam of the K ink image formed by the pair of heads K12 and the seam of the C ink image formed by the pair of heads C12 can be shifted in the Y axis direction.

Similarly, raster lines belonging to the nozzle region NA2 are formed by droplets which are alternately discharged from the nozzles 62 belonging to the nozzle region NA2 of the head M1 and the nozzles 62 belonging to the nozzle region NA2 of the head M2. Raster lines belonging to the nozzle region NA1 are formed by droplets which are alternately discharged from the nozzles 62 belonging to the nozzle region NA1 of the head Y1 and the nozzles 62 belonging to the nozzle region NA1 of the head Y2. Accordingly, without shifting the position of the pair of heads M12 and Y12 in the Y axis, the positions of the seam of the M ink image formed by the pair of heads M12 and the seam of the Y ink image formed by the pair of heads Y12 can shift in the Y axis direction.

As described above, since the positions of the pairs of heads K12 and C12 in the Y axis are shifted in the −Y axis direction by the length of the overlapping portion OL with respect to the pairs of heads M12 and Y12, the position of the seam of the image which is formed for each ink color can be shifted in the Y axis direction. Accordingly, the printing quality of images printed on the medium W or the like can be improved. In addition, since the positions of the pairs of heads K12 and C12 in the Y axis direction are the same and the positions of the pairs of heads M12 and Y12 in the Y axis direction are also the same, the size of the head unit 2 in the Y axis direction can be reduced.

In the embodiment, although the pairs of heads K12, C12, M12, and Y12 for a pair of each color are provided in the head unit 2, it is not limited to this. A plurality of pairs of heads of each color may be provided along the Y axis direction so as to form overlapping portions OL with each other. In addition, a plurality of pairs of heads of each color may be provided along the X axis direction.

As described above, according to the recording device 1 of the embodiment, the following effects can be obtained.

The head unit 2 includes a plurality of pairs of heads K12, C12, M12, and Y12 along the X axis, and each of the pairs of heads K12, C12, M12, and Y12 has the overlapping portion OL which is divided into a first nozzle region NA1 and a second nozzle region NA2 along the X axis direction.

Although the positions of the pairs of heads K12 and C12 in the Y axis are the same, since the seam of the K ink image and the seam of the C ink image are formed by the nozzles 62 belonging to different nozzle regions, the seam of the K ink image and the seam of the C ink image can be shifted in the Y axis direction.

Although the positions of the pairs of heads M12 and Y12 in the Y axis are the same, since the seam of the M ink image and the seam of the Y ink image are formed by the nozzles 62 belonging to different nozzle regions, the seam of the M ink image and the seam of the Y ink image can be shifted in the Y axis direction.

In addition, since the overlapping portion OL of the pairs of heads K12 and C12 is arranged so as not to overlap with the overlapping portion OL of the pairs of heads M12 and Y12 in the X axis direction, the position of the seam of the images formed for each ink color can be shifted in the Y axis direction. Accordingly, the printing quality of images printed on the medium W or the like can be improved. In addition, since the position along the Y axis of the pair of heads K12 is the same as the position along the Y axis of the pair of heads C12 and the position along the Y axis of the pair of heads M12 is the same as the position along the Y axis of the pair of heads Y12, the size of the head unit 2 in the Y axis direction can be reduced. Therefore, the recording device 1 which can achieve both improvement in printing quality and miniaturization of the device can be provided.

Embodiment 2

Figure 5:
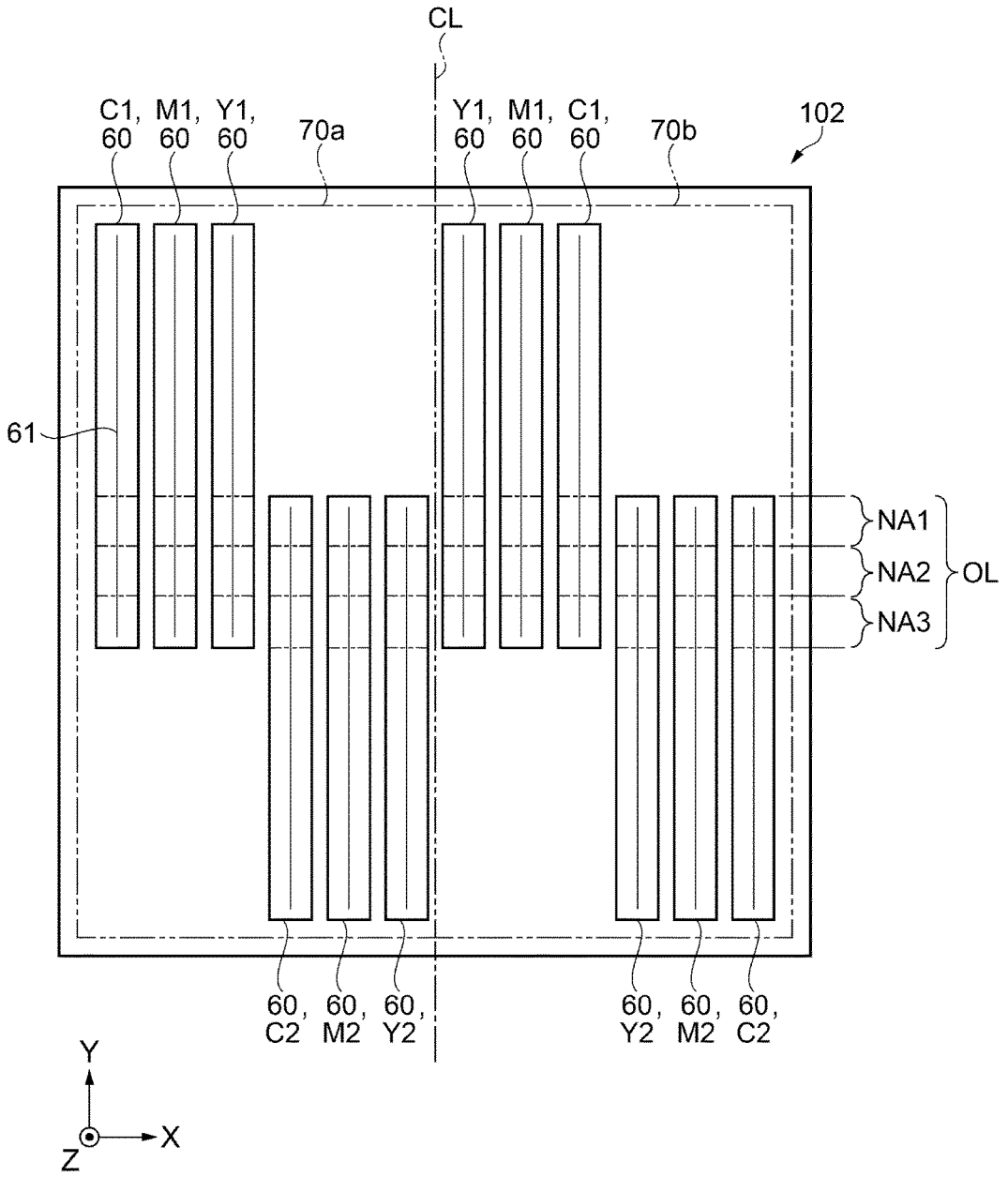
FIG. 5 is a plan view illustrating a configuration example of a head unit which is included in a recording device according to Embodiment 2.

FIG. 5 is a plan view illustrating a configuration example of the head unit which includes a recording device according to Embodiment 2. The same reference numerals are used for the same components as those of Embodiment 1, and overlapping explanations are omitted. In addition, a recording device 101 of the embodiment performs printing using three colors of cyan (C), magenta (M), and yellow (Y).

As illustrated in FIG. 5, the head unit 102 has two sets of head groups 70*a* and 70*b* which are configured by the pairs of heads C12, M12, and Y12. The head group 70*a* is provided on the −X axis side of the center line CL along the Y axis of the head unit 102 and the head group 70*b* is provided on the +X axis side of the center line CL of the head unit 102.

Six heads 60 each having a nozzle column 61 along the Y axis include the head C1, the head M1, the head Y1, the head C2, the head M2, and the head Y2 in this order along the +X axis in the head group 70*a*.

The head C1 and the head C2 form a pair of heads C12 which discharge C ink, the head M1 and the head M2 form a pair of heads M12 which discharge the M ink, and the head Y1 and the head Y2 form a pair of heads Y12 which discharge the Y ink.

The pairs of heads C12, M12, and Y12 have a predetermined overlapping portion OL in which the nozzle columns 61 overlap with each other in a side view from the X axis. Further, the overlapping portion OL has a plurality of nozzle regions (first nozzle region NA1, second nozzle region NA2 and third nozzle region NA3) divided along the X axis. Specifically, in each pair of heads C12, M12, and Y12, in a side view from the X axis, the −Y axis end side of the first head C1, M1, Y1 and the +Y axis end side of the second head C2, M2, Y2 are overlapped with each other by the width of a predetermined overlapping portion OL. The overlapping portion OL of each pair of heads C12, M12 and Y12 is divided into three, that is, into the first nozzle region NA1, the second nozzle region NA2, and the third nozzle region NA3 in this order along the +Y axis.

The positions of the plurality of pairs of heads C12, M12, and Y12 in the Y axis are the same and the positions of the overlapping portion OL and the first to third nozzle regions NA1, NA2, and NA3 in the Y axis are also the same between the plurality of pairs of heads.

The pair of heads C12 discharge droplets from both the head C1 and the head C2 in the third nozzle region NA3, the pair of heads M12 discharge droplets from both the head M1 and the head M2 in the second nozzle region NA2, and the pair of the heads Y12 discharge droplets from both the head Y1 and the head Y2 in the first nozzle region NA1. Accordingly, without shifting the positions of the pair of heads C12, M12, and Y12 in the Y axis, the seam of the C ink image by the pair of heads C12, the seam of the M ink image by the pair of heads M12, and the seam of the Y ink image by the pair of heads Y12 can be shifted in the Y axis direction. Accordingly, the printing quality of images printed on the medium W or the like can be improved. In addition, since the positions of the pairs of heads C12, M12, and Y12 in the Y axis are the same, the size of the head unit 102 in the Y axis direction can be reduced.

In the head group 70*b*, six heads 60 each having a nozzle column 61 along the Y axis direction include the head Y1, the head M1, the head C1, the head Y2, the head M2, and the head C2 in this order along the +X axis, and thus three sets of the pairs of heads C12, M12, and Y12 are formed. Like the head group 70*a*, each of the pairs of heads C12, M12, and Y12 has an overlapping portion OL divided into three in the first nozzle region NA1, the second nozzle region NA2, and the third nozzle region NA3. In other words, in the head group 70*b*, the pair of heads C12 and the pair of heads Y12 of the head group 70*a* are switched in position in the X axis direction. Since two head groups 70*a* and 70*b* are provided in the head unit 102, the printing speed of the recording device 101 can be improved and the printing quality can be improved.

In addition, the colors of the droplets which are discharged from the head 60 arranged along the second axis (X axis) is line-symmetrical with respect to the center line CL along the first axis (Y axis direction) of the head unit 102, by disposing the head groups 70*a* and 70*b* including the six heads 60 in the above described order on the head unit 102. Accordingly, the printing quality of the recording device 101 can be improved.

Specifically, in a case where droplets of different colors are landed on the same location (pixel), the landing order of the droplets can be the same by droplets being discharged from different head groups 70*a* and 70*b* in the main scanning in the +X axis direction and the main scanning in the −X axis direction.

For example, in a case where cyan droplets discharged from the head C1 and yellow droplets discharged from the head Y1 land on the same location (pixel) to print green color, the recording device 101 of the embodiment discharges the droplets from the heads C1 and Y1 of the head group 70*b* in the main scanning in the +X axis direction and discharges the droplets from the heads C1 and Y1 of the head group 70*a* in the main scanning in the −X axis direction. Accordingly, both in the main scanning in the +X axis direction and in the main scanning in the −X axis direction, since cyan droplets and yellow droplets land on the medium W in this order, the color difference can be eliminated which is generated by difference of the landing order.

In the embodiment, although the head groups 70*a* and 70*b* include a pair of heads C12, M12, and Y12 for each color, the invention is not limited to this. A plurality of pairs of heads of each color may be provided along the Y axis direction so as to form overlapping portions OL with each other.

As described above, according to the recording device 101 of the embodiment, the following effects can be obtained.

The head unit 102 has two sets of head groups 70*a* and 70*b* having the same position in the Y axis. The head group 70*a* and the head group 70*b* include a plurality of pairs of heads C12, M12, and Y12 along the X axis, and each pair of heads C12, M12, and Y12 has the overlapping portion OL which is divided into the first nozzle region NA1, the second nozzle NA2 and a third nozzle region NA3 along the X axis.

Although the positions of each pair of heads C12, M12, Y12 in the Y axis are the same, since the seam of a C ink image, the seam of a M ink image, and the seam of a Y ink image are formed from nozzles 62 belonging to different nozzle regions, the positions of the seams of the image formed for each ink color can be shifted in the Y axis direction. Accordingly, the printing quality of images printed on the medium W or the like can be improved. In addition, since the positions of the pairs of heads C12, M12, and Y12 in the Y axis are the same, the size of the head unit 102 in the Y axis direction can be reduced.

Since the head unit 102 includes the head groups 70*a* and 70*b* in which the colors of the droplets discharged from the heads 60 arranged along the X axis are line-symmetrical with respect to the center line CL along the Y axis, the color difference can be eliminated which is generated by difference of the landing order of the droplets in the main scanning in the +X axis direction and in the main scanning in the −X axis direction. Thereby, the printing quality of the recording device 101 can be improved.

This application claims priority under 35 U.S.C. § 119 to Japanese Patent Application No. 2016-056608, filed Mar. 22, 2016. The entire disclosure of Japanese Patent Application No. 2016-056608 is hereby incorporated herein by reference.

What is claimed is:

1. A recording device comprising:

a transporting portion adapted to transport a medium in a transporting direction along a first axis, wherein a direction intersecting with the transporting direction is defined as a second axis, a head unit which includes a plurality of pairs of heads arrayed along the second axis, wherein each pair of heads includes two heads adapted to discharge droplets of the same color, and each head includes a nozzle column extending along the first axis, the nozzle column comprising a length of a plurality of nozzles, wherein the length of the plurality of nozzles extends along the first axis, which is the transporting direction, such that the length of the plurality of nozzles runs in parallel to the transporting direction, and a control portion adapted to control transport of the medium by the transporting portion and discharge of droplets by the head unit, wherein each pair of heads includes a predetermined overlapping portion in which the nozzle columns of the pair of heads are overlapped with each other when viewed along the second axis, wherein each overlapping portion includes a plurality of nozzle regions divided along the first axis, wherein the control portion is adapted to control the head unit such that, in at least one of the pairs of heads, a position of a nozzle region which is used to discharge the droplets from both heads in the pair of heads is different from a position of a nozzle region which is used to discharge the droplets from both heads in another pair of heads among the plurality of pairs of heads, and wherein a center line running parallel to the transport direction divides the head unit such that a first group of heads are disposed on a first side of the center line and a second group of heads are disposed on a second side of the center line, and wherein, in a case where droplets of different colors are landed on a same pixel location, a landing order of the different colored droplets is required to be the same as between the first group of heads and the second group of heads.

2. The recording device according to claim 1, wherein at least two of the plurality of pairs of heads have the same position in the first axis.

3. The recording device according to claim 1, wherein an array of the colors of the droplets which are discharged from the heads arranged along the second axis is line-symmetrical with respect to the center line along the first axis of the head unit.

* * * * *